United States Patent [19]

Mannila et al.

[11] 4,048,442

[45] Sept. 13, 1977

[54] STEREOPHONIC SOUND ADAPTOR FOR SIMULATING SOUND MOVEMENT

[76] Inventors: Richard S. Mannila, Star Rt., Box 51, Marcola, Oreg. 97454; Fred E. Mannila, 1425 Hayden Bridge Road, Springfield, Oreg. 97477; Donald A. Mannila, Star Rte. Box 52, Marcola, Oreg. 97454

[21] Appl. No.: 579,856

[22] Filed: May 22, 1975

[51] Int. Cl.[2] ..... H04R 5/00

[52] U.S. Cl. ..... 179/1 GP; 179/1 GQ

[58] Field of Search ..... 179/1 G, 1 GP, 1 GQ, 179/1 SW; 84/1.27, DIG. 1, DIG. 27; 340/338

[56] References Cited

U.S. PATENT DOCUMENTS

| | | | |
|---|---|---|---|
| 3,026,378 | 3/1962 | Fine et al. | 179/1 G |
| 3,156,770 | 11/1964 | Trainor | 179/1 G |
| 3,374,315 | 3/1968 | Gladwin | 179/1 G |
| 3,665,105 | 5/1972 | Chowning | 179/1 GQ |
| 3,757,046 | 9/1973 | Williams | 179/1 G |
| 3,848,092 | 11/1974 | Shamma | 179/1 GP |
| 3,873,779 | 3/1975 | Wedan | 179/1 G |

*Primary Examiner*—Douglas W. Olms
*Attorney, Agent, or Firm*—Francis Swanson

[57] ABSTRACT

A stereophonic sound adaptor for producing the illusion of moving sound is disclosed. The device includes a plurality of output speakers in conjunction with a stereo amp output and an electro-mechanical transfer station. Through the electro-mechanical transfer station, signals from the stereo amp output are sequentially switched to various combinations of speakers so as to produce the illusion of sound movement in a room.

2 Claims, 6 Drawing Figures

FIG. 2
SPEAKERS
| CAM POSITION | 18 | 20 | 22 | 24 | 26 | 28 |
|---|---|---|---|---|---|---|
| A | C-O Ch-2 | | | C-U Ch-1 | | |
| B | | C-P Ch-2 | | | C-V Ch-1 | |
| C | | | C-Q Ch-2 | | | C-W Ch-1 |
| D | C-X Ch-1 | | | C-R Ch-2 | | |
| E | | C-Y Ch-1 | | | C-S Ch-2 | |
| F | | | C-Z Ch-1 | | | C-T Ch2 |
C = CAM
Ch = CHANNEL
FIG. 3
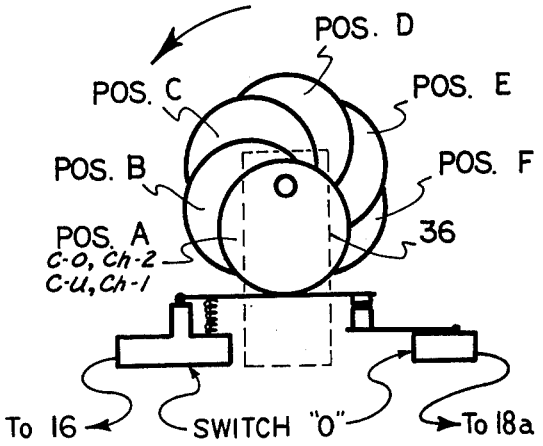
FIG. 4
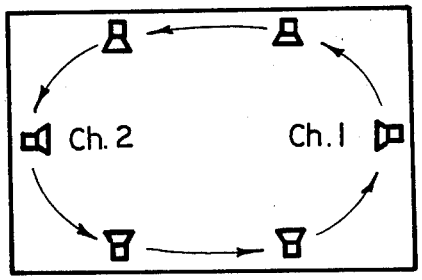
FIG. 5
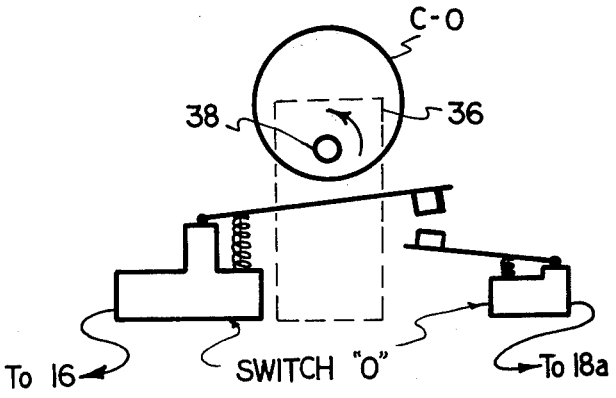

STEREOPHONIC SOUND ADAPTOR FOR SIMULATING SOUND MOVEMENT

BACKGROUND OF THE INVENTION

1. Field of the Invention

The present invention relates to stereophonic sound systems and more particularly those adapted to produce special effects using a plurality of input channels and output speakers.

2. Description of the Prior Art

Numerous stereophonic sound systems are well-known in the present state of the art. For example, motion picture theaters use multiple channel systems which relate the sound source to the position of the actor appearing on the screen. The voice of an actor appearing on the far left of the screen will appear to emanate from the left side of the theater. Sounds emanating from sources to the right of the screen will appear to come from the right side of the theater and so on. Phase modulation techniques are sometimes used with multiple channel systems to produce desirable effects in concert halls and theaters. One such system is disclosed in U.S. Pat. No. 3,761,631. Other systems are known which will electronically sort out the various frequencies in the sound spectrum and direct them to discrete speakers in preferred locations according to the taste of the designer.

SUMMARY OF THE INVENTION

It is an object of the present invention to provide a stereophonic sound system which produces the illusion of moving sound within a room, theater or auditorium.

A further object of the invention is to provide a simple system of adapting multiple channel output of a stereo amplifier to a plurality of speakers so as to produce a unique and desirable sound pattern within an enclosure such as a room. A further object of the invention is to provide an electromechanical transfer station to effect the connection of multiple channel inputs from a stereo amplifier to a plurality of speakers in a predetermined pattern wherein said pattern may be selectively modified by the operator.

Further objects and advantages of the invention will become apparent to one skilled in the art by reference to the drawings and specifications which follow.

DESCRIPTION OF THE DRAWINGS

FIG. 2 is a table relating the input channels to the speakers relative to the cam positions of the electromechanical transfer station as shown in FIG. 3.

FIG. 3 illustrates the various positions of the cams during movement within the transfer station as they relate to the speakers and channels. FIG. 3 is interpreted with reference to the table of FIG. 2.

FIG. 4 illustrates a typical arrangement of six speakers within a room and relates the illusion of movement of the sound in terms of the input channels.

FIG. 5 is a representation of cam-switch of the transfer station.

DESCRIPTION OF THE ILLUSTRATIVE EMBODIMENT

Figure 1:
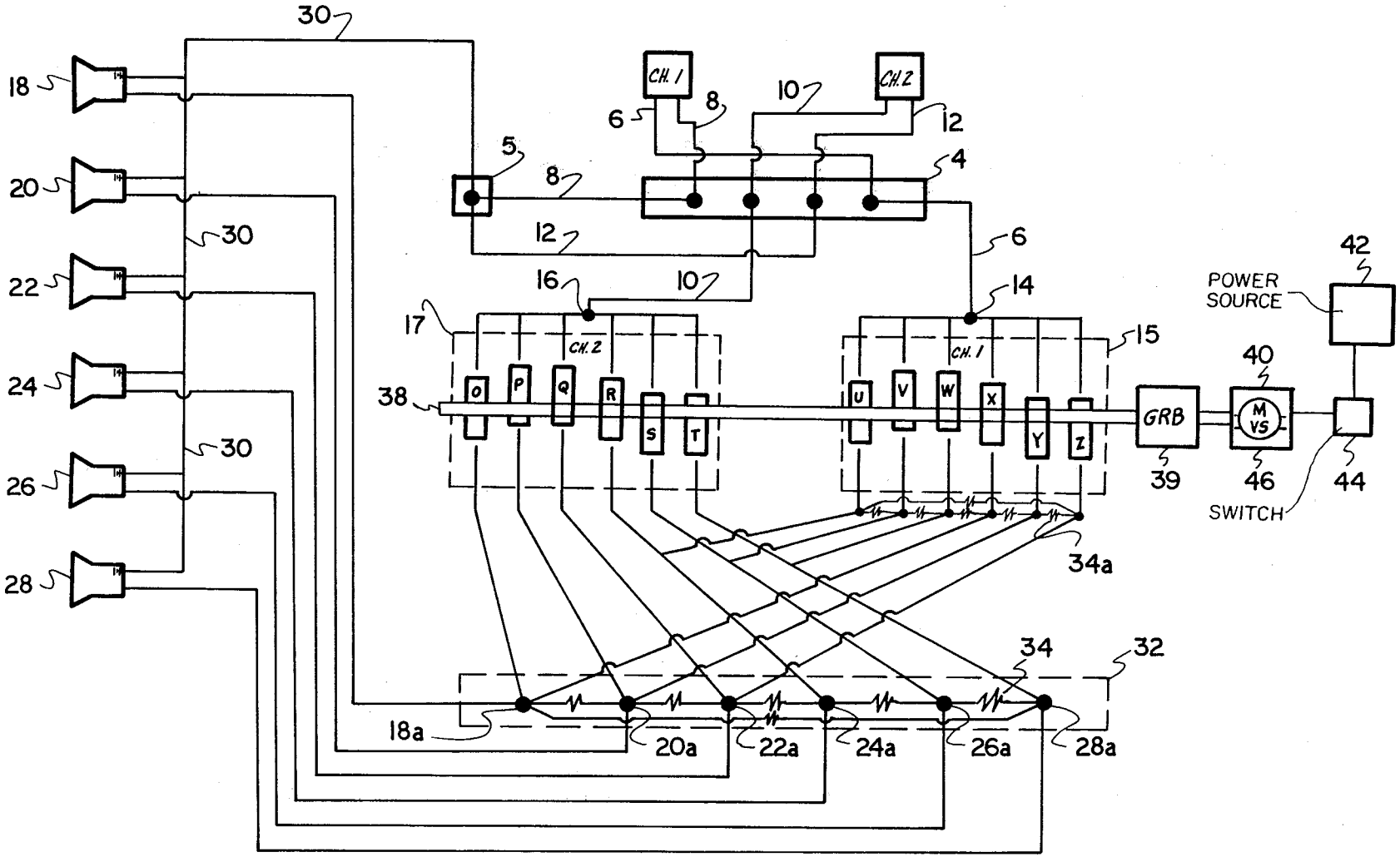
FIG. 1 is a schematic representation of the system showing an embodiment having two stereo amplifier output channels and six speakers.
Figure 6:
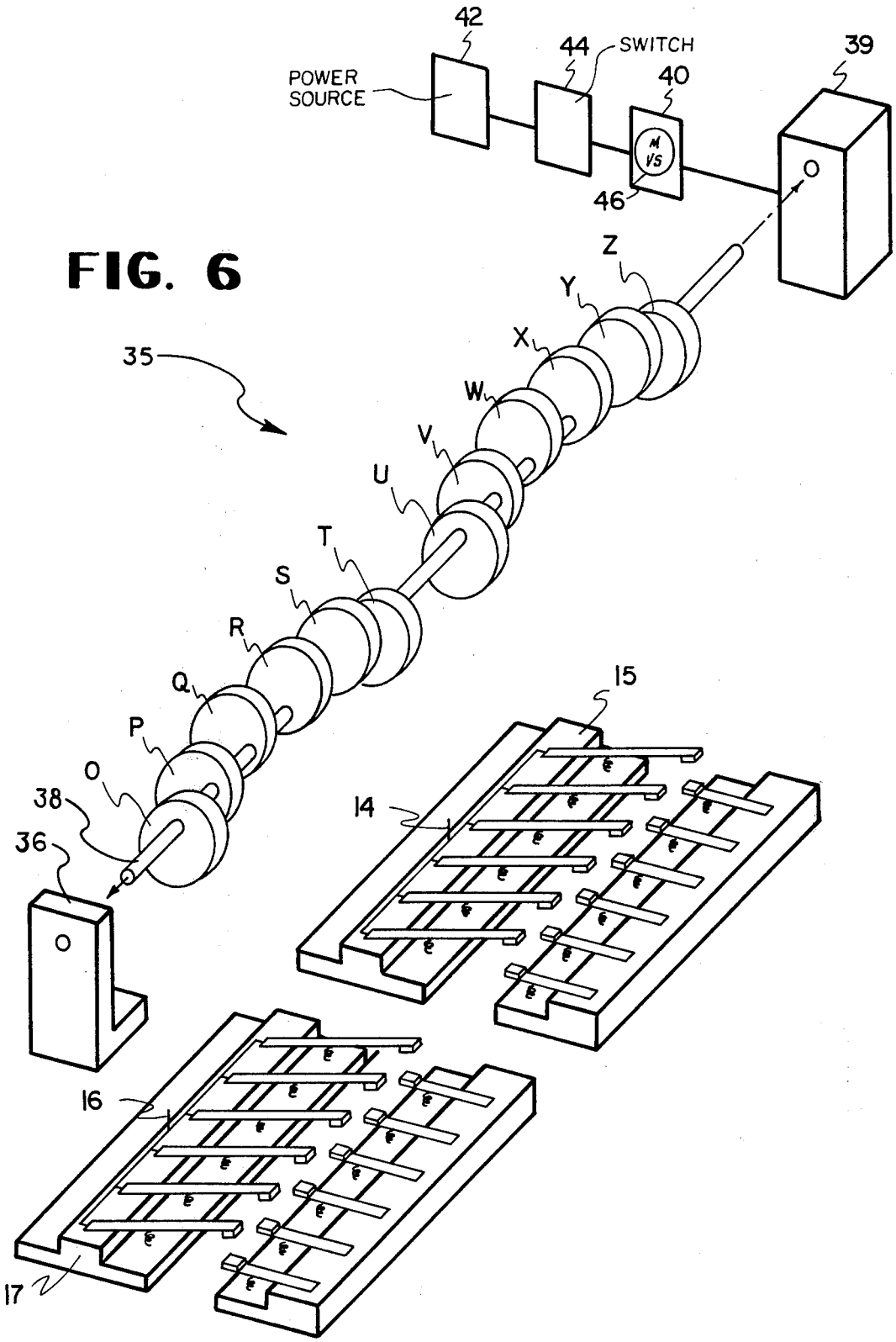
FIG. 6 is an exploded illustration of the transfer station.

Referring now to the drawings, FIG. 1 shows by schematic presentation, the system having a stereo amplifier output containing two channels, these being labeled 1 and 2 respectively. Channels 1 and 2 are connected to a wiring terminal 4. Channel 1 is connected to terminal 4 by lead wire 6 and ground wire 8. Channel 2 is connected to terminal 4 by lead wire 10 and ground wire 12. Ground wires 8 and 12 are both connected to terminal 4 to a common ground junction 5. Channel 1 is connected to a junction 14 by an extension of lead wire 6 which connects with terminal block 15. The terminal block 15 contains six switches labeled respectively U, V, W, X, Y and Z. One contact pole of each switch is wired in common with the other switches to junction 14.

Channel 2 is connected to a junction 16 by an extension of lead wire 10 which is connected to terminal block 17. The terminal block 17 also contains six switches labeled respectively, O, P. Q, R, S and T. One contact pole of each switch is wired in common with the others to junction 16.

The schematic of FIG. 1 shows six individual speakers numbered 18, 20, 22, 24, 26 and 28 respectively. These speakers are all connected by a common ground 30 to ground junction 5 of wiring terminal 4. A speaker wiring terminal block 32 contains a junction for each individual speaker and each individual speaker is connected to its junction. Thus, speaker 18 is connected to junction **18*a* within terminal 32. Speaker 20 is connected to terminal 20*a* and so on. A series of resistors 34, each having the same value, are connected in series between each speaker junction. A second set of resistors 34*a*, each having the same value, are connected in series to the free pole of the switches U through Z and back to U in terminal block 15.**

Returning now to switches U, V, W, X, Y and Z in terminal block 15 it is seen that while one pole of each switch was connected to channel 1 via junction 14, the other free pole of each of said switches is connected individually to only one of the speaker junctions in speaker terminal block 32. Thus, for example, one pole of switch U is connected in common with the others in terminal block 15 to junction 14 while the free pole of switch U is connected individually to speaker terminal **24*a*. The same is true of the other switches V through Z. The free pole of switch V is connected to 26*a*, W to 28*a*, X to 18*a*, Y to 20*a*, and Z to 22*a*. The same arrangement for channel 2 is continued in terminal block 17 relative to switches O through T. Each of the switches has one pole sharing a common connection with junction 16. The remaining free pole of each switch is individually connected to one of the speaker junctions in speaker terminal block 32 thus the free pole of switch O is connected to speaker junction 18*a*, P to 20*a*, Q to 22*a*, R to 24*a*, S to 26*a* and T to 28*a*. It is thus seen that either channel 1 or channel 2 may be connected to each of the individual speakers through switches O through Z. These switches, in conjunction with the cam mechanism described below, constitute the transfer station 35.**

Each of the above switches O through Z is turned on and off via a cam mechanism consisting of a frame 36 upon which is mounted a shaft 38. The shaft contains a series of cams; one for each switch. For clarity of illustration, each cam lobe is labeled to correspond to the switch it operates. Thus cam O operates switch O, cam P operates switch P and so forth.

Shaft 38 is connected opposite the frame 36 to a gear reduction assembly 39 which is operatively connected to an electric motor 40. The motor 40 is connected to power source 42. This power source may be an ordinary house current or it may be a battery. A switch 44 to turn the mechanism on and off and a variable speed control 46 for varying the speed of motor 40 is interposed between the motor 40 and the power source 42. These are commonly available elements and thus are illustrated only as numbered boxes.

OPERATION

When it is desired to operate the unit, switch 44 is turned on and speed control 46 adjusted to produce the desired cam rotational speed within the transfer station 35. Through the selective closing of various switches in pairs by the cams of transfer station 35, the sounds from channels 1 and 2 are fed selectively to pairs of speakers in a predetermined sequence. FIG. 4 shows how these speakers may be placed about a typical room. The position of the cams relative to each other is such that sound from channels 1 and 2 always emanate from speakers positioned oposite one another. Thus, the rotation of the cams in transfer station 35 will close appropriate switches in the series O through Z and feed sound to appropriate pairs of speakers. To illustrate, assume that speaker 18 is connected with channel 1 sound. The position of the cams will be such that speaker 24 will be simultaneously activated with channel 2 sound. Further rotation of the cams in transfer station 35 will open and close appropriate switches carrying channel 1 sound to speaker 20 while channel 2 sound is simultaneously directed to speaker 26. The sound from channels 1 and 2 are always separated and always appear in oppositely positioned speakers. This produces the illusion of stereo sound moving about the room in the path illustrated in FIG. 4. The series of resistors 34 and **34*a* allow the sound from channels 1 and 2** to travel through the speakers with a smooth uninterrupted flow.

The position of the cams O through Z relative to one another along shaft 38 determine the sequence of opening and closing of switches O through Z and thus the sound pattern produced in the speaker network. FIG. 2 is a table which relates the positions of the cams to speaker operation. Thus, FIG. 3 shows cam O in position A. The cam lobe is down and switch O is closed. It is seen from the table of FIG. 2 that channel 2 is connected to speaker 18. It is also seen from the table that cam U is in position A and channel 1 is simultaneously connected to speaker 24. Because FIG. 3 illustrates the cams of transfer station 35 in motion, it is seen that cams P and V are in position B and about to close their respective switches. When these switches close, channel 2 will be connected to speaker 20 and channel 1 to speaker 26. Position C of FIG. 3 as viewed in conjunction with the table of FIG. 2 shows that cams Q and W are only starting to close their respective switches. Position D when read with the table of FIG. 2 shows that cam lobes X and R are up and their respective switches completely open. Positions E and F when read with FIG. 2 show that the respective switches of cams R, S, Z and T have opened and the cam lobes are moving to the uppermost point in their rotation.

It is easily seen that any number of channels or speakers may be used with the described system. It is only necessary to provide the number of speakers desired and to provide a sufficient number of cams and switches in the transfer station.

Although a preferred embodiment of the invention has been illustrated, and that form described in detail, it will be readily apparent to those skilled in the art that various modifications may be made therein without departing from the spirit of the invention or from the scope of the appended claims.

I claim:

1. A stereophonic sound system comprising:

electronic signal input means having first and second separate channels;

an electro-mechanical transfer station including an elongate rotatable shaft driven by a variable speed motor, the transfer station having a first and second separate junction block therein, each junction block connected to a separate channel;

a plurality of individual switches within each separate junction block, the switches all operatively connected to the channel associated with the junction block, the junction block associated with the first channel further including a plurality of resistors, one resistor interposed between each switch within the junction block associated with the first channel;

a first set of individual cams mounted eccentrically on the rotatable shaft, each cam operable to open and close a separate switch within the first junction block;

a second set of individual cams eccentrically mounted on the rotatable shaft separate from the first set of cams, each cam operable to open and close a separate switch within the second junction block;

a speaker network including a plurality of speakers, the network including a speaker terminal block which includes an individual terminal operatively connected to one speaker in the network, each speaker in the network being operatively connected through a terminal to one switch in the first junction block and to one switch in the second junction block;

and a plurality of resistors within the speaker terminal block, one resistor interposed between each of the individual terminals within the terminal block;

the cams within the first and second junction blocks operable to simultaneously connect pairs of speakers within the speaker network in a predetermined sequence to produce the illusion of moving sound within a room, one speaker of the pair being connected to the first channel while the second speaker of the pair is simultaneously connected to the second channel, the resistors within the first junction block and the resistors within the speaker terminal block operable so that smooth uninterrupted transition of sound through the speaker network is effected when the cams open and close the switches.

2. Apparatus according to claim 1 wherein all the switches have at least two electrical contacts, one electrical contact of each switch being connected to a common wiring terminal within the junction block, the other electrical contact of the switch being operatively connected to a speaker within the speaker network.

* * * * *